US005729875A

United States Patent [19]

Margulis

[11] Patent Number: 5,729,875

[45] Date of Patent: Mar. 24, 1998

[54] GARMENT CLOSING APPARATUS AND METHOD OF CLOSING SAME

[76] Inventor: Ann M. Margulis, 575 Yarboro, Bloomfield Hills, Mich. 48304

[21] Appl. No.: 714,226

[22] Filed: Sep. 16, 1996

[51] Int. Cl.[6] ..... A44B 21/00

[52] U.S. Cl. ..... 24/499; 24/517

[58] Field of Search ..... 24/499, 505, 517; 63/40, 29.1, 20

[56] References Cited

U.S. PATENT DOCUMENTS

| | | | |
|---|---|---|---|
| 509,551 | 11/1893 | Ohrnstedt . | |
| 687,446 | 11/1901 | Washburn . | |
| 705,065 | 7/1902 | Friedrich . | |
| 732,798 | 7/1903 | Tomlinson . | |
| 771,718 | 10/1904 | Copeland . | |
| 772,601 | 10/1904 | Alexander . | |
| 1,022,663 | 4/1912 | Ehmann . | |
| 1,417,129 | 5/1922 | Armstrong . | |
| 1,528,807 | 3/1925 | Williams . | |
| 1,849,020 | 3/1932 | Allison . | |
| 1,878,028 | 9/1932 | Trifari | 63/20 |
| 1,920,875 | 8/1933 | Miskend | 63/20 |
| 1,937,347 | 11/1933 | Katz | 63/20 |
| 1,986,803 | 1/1935 | Frink | 63/40 X |
| 2,013,760 | 9/1935 | McSoley | 24/499 |
| 2,225,379 | 12/1940 | Pulver . | |
| 2,326,558 | 8/1943 | Pelz . | |
| 2,377,688 | 6/1945 | Hubbell . | |
| 2,427,478 | 9/1947 | Shatkin . | |
| 2,773,293 | 12/1956 | Watson . | |
| 2,863,306 | 12/1958 | Bangs et al. . | |
| 2,964,813 | 12/1960 | Marchand . | |
| 3,990,266 | 11/1976 | Saccoccio . | |
| 4,003,216 | 1/1977 | Cecere et al. . | |
| 5,048,311 | 9/1991 | Mastrobuono | 63/29.1 X |
| 5,236,760 | 8/1993 | Jinn . | |
| 5,441,188 | 8/1995 | Rosenstein . | |

FOREIGN PATENT DOCUMENTS

| | | |
|---|---|---|
| 283 437 AZ | 3/1988 | European Pat. Off. . |

*Primary Examiner*—James R. Brittain

*Attorney, Agent, or Firm*—Harness, Dickey & Pierce, P.L.C.

[57] ABSTRACT

A garment closing apparatus is provided comprising a base having a first clasping surface extending upwardly from a first end and a second clasping surface extending upwardly from a second end. A generally U-shaped spring clasp is rotatably coupled to the base such that it is movable to vary the dosing apparatus between an open mode and a closed mode. A wafer is adapted to support a decorative button thereon and is coupled to a U-shaped clip having a slot formed therein. The slot is adapted to receive a cylindrical post upstandingly secured to the base. The base is attached to an intersection point of a left bodice and right bodice of a blouse, dress, or blazer by configuring the closing apparatus to an open position, inserting the overlapping bodice material between the spring clasp and the first and second clasping surfaces and rotating the spring clasp to a closed position. The wafer is secured to the base by inserting the upstanding cylindrical post into the slot of the U-shaped clip.

26 Claims, 2 Drawing Sheets

GARMENT CLOSING APPARATUS AND METHOD OF CLOSING SAME

BACKGROUND OF THE INVENTION

1. Technical Field

This invention generally relates to a closure device for fastening material together. More particularly, the present invention relates to a clasp for fastening together the intersection of a first side and a second side of a V-neck blouse, dress, or blazer bodice to prevent gaping of material and exposure thereunder.

2. Discussion

As is generally known in the art of garment design, blouses, dresses, and blazers are commonly designed with a neckline shape similar to a "V". Often, these designs simply overlap the left side of the bodice and the right side of the bodice at an intersection defining the lowest point of the neckline. Usually, the left and right Bodice halves are held together by buttons or snaps located well below the intersection point. It is therefore common for the garment to gap or open along the seam at the intersection point to the buttons or snaps below. Gaping exposes the area beneath the garment and potentially embarrasses the garment wearer.

Conventionally, bodice halves are secured, if at all, by a straight pin, safety pin, or stitch. However, these devices do not adequately hold the material together at the intersection point to prevent exposure. Also, these systems do not provide the blouse wearer an option to decorate the intersection point with a broach, button, or provide the blouse wearer an option to decorate the intersection point with a broach, button, or the like. Furthermore, previous systems frequently damage the garment by creating pin holes, snags and similar tears at the intersection point. This is especially true for expensive silk blouses.

Therefore, it is desirable to provide a system for securing the intersection point of the right bodice of a garment and the left bodice of a garment such that gaping and exposure is prevented and further provides the option to decoratively accent the garment.

SUMMARY OF THE INVENTION

The above and other objects are provided by a garment dosing apparatus comprising a base having a first clasping surface extending upwardly from a first end and a second clasping surface extending upwardly from a second end. A generally U-shaped spring clasp is rotatably coupled to the base such that it is movable to vary the closing apparatus between an open position and a closed position. A wafer is adapted to support a decorative button thereon and is coupled to a U-shaped dip having a slot formed therein. The slot is adapted to receive a cylindrical post upstandingly secured to the base. The base is attached to an intersection point of a left bodice and right bodice of a blouse, dress, blazer, or other garment by configuring the closing apparatus to an open position, inserting the overlapping bodice material between the spring clasp and the first and second clasping surfaces and rotating the spring clasp to the closed position. The wafer is secured to the base by inserting the upstanding cylindrical post into the slot of the U-shaped clip.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

Figure 1:
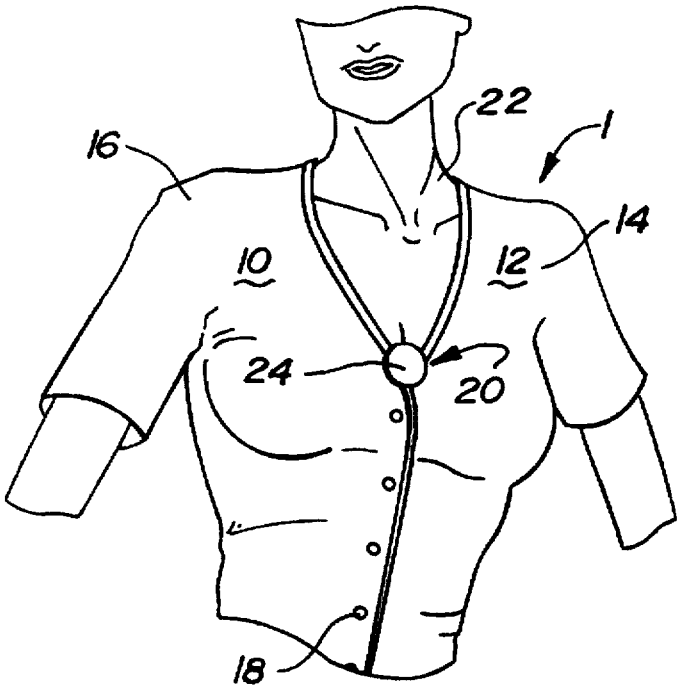
FIG. 1 is a perspective view of a clothing clasp secured to an intersection point of a left side bodice and a right side bodice of a blouse according to the present invention.

Referring now to FIG. 1, a garment closing apparatus for securing the intersection of a right bodice and a left bodice of a dress, blouse, blazer, or other garment is shown generally at 1. As can be seen, the intersection of the bodice halves is securely fastened to prevent gaping or opening and is decoratively accented. Conventionally, the right and left sides of a bodice are merely overlapped at the intersection point in V-neck or low cut blouses, dresses, or blazers. Such overlapping can result in undesired gaping or opening of the bodice and exposure thereunder. Straight pins, safety pins, and stitches have been added to dresses, blouses, and blazers in an attempt to solve this problem. However, these systems do not easily and releasably fasten the material at the intersection point and do not add to the outfit's overall appearance. It should be noted that while special emphasis is given to blouses in this specification, the present invention is also well suited for use with other garments, such as, for example, holding the free ends of a scarf together such that the scarf is secured around a neck or attaching a scarf to a blouse neckline or bodice intersection point.

Still referring to FIG. 1, the clasp 1 is shown secured at the intersection of a right side 10 and a left side 12 of a bodice 14 of a blouse 16. Although a blouse 16 is shown, it should be noted that the clasp 1 is operable to be secured to any material edge or intersection but is preferably employed at the neck line of a V-neck or open neck blouse, dress, or blazer. The blouse 16 includes buttons 18 for securing the right side 10 to the left side 12 of the bodice 14. However, according to the dress design, the material simply overlaps at the intersection 20. Thus, the right side 10 is prone to fold away from the left side 12 as the garment wearer 22 moves about or leans forward.

The clasp 1 is adapted to secure the right side 10 and the left side 12 together such that the garment wearer 22 may move about freely with confidence that the intersection 20 will remain gap free. Thus, the clasp 1 prevents exposure beneath the blouse 16 at the intersection 20. Also, the clasp 1 is adapted to display an interchangeable decorative button or broach 24 to accent the blouse 16 and conceal the clasp 1.

Figure 2:
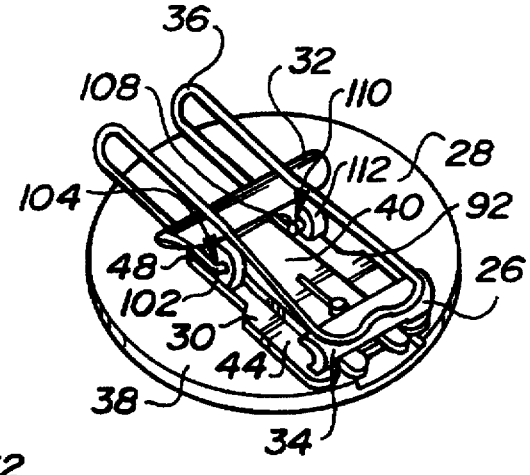
FIG. 2 is a perspective view of a clothing clasp including a removable button portion according to the present invention.

Referring now to FIG. 2, the clasp 1 is shown to comprise a fastener 26 and a button 28. To be described in greater detail below, the fastener 26 generally includes a base 30, first and second clasping surfaces 32, 34 and a clamp 36. The clamp 36 is journally mounted to the base portion 30 so as to be rotatable between a first and a second position to vary the clasp 1 between an open mode or position (see FIG. 9) and a closed mode or position. As shown in FIG. 2, the clasp 1 is in a closed mode.

One or more pieces of material (not shown) are insertable between the clamp 36 and the first and second clasping surfaces 32, 34 when the clasp 1 is in an open mode. The clamp 36 is then rotated towards the base portion 30 to fix the material securely between the clamp 36 and the first and second clasping surfaces 32, 34. Accordingly, a closed mode is effectuated.

Also described in greater detail below, the button 28 includes a wafer 38 and a clip 40 secured thereto. The clip 40 is adapted to be removably mounted to the base 30 to secure the button 28 to the fastener 26. It should be noted, however, that the fastener 26 is operable to be secured to the material of a garment independently of the button 28. Therefore, the particular ornamental appearance of the button 28 used in conjunction with the fastener 26 is variable. As noted above, the button 28 conceals the fastener 26 and accents the blouse 16 when secured thereto.

Figure 3:
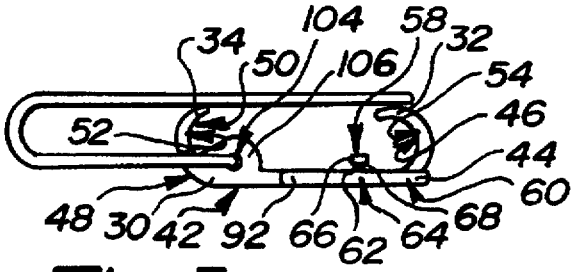
FIG. 3 is a schematic side view of a clasp portion of a clothing clasp in a closed position according to the present invention.

Turning now to FIG. 3, the fastener 26 is shown in a closed mode. The fastener 26 includes a generally C-shaped metal body portion 42 including the base 30. The base 30 includes a first upwardly projecting arcuate clasping surface 32 extending from a first end 44. Although the first arcuate surface 32 can be constructed to any desired radius, in the preferred embodiment of the present invention, the radius of curvature 46 of the first arcuate surface 32 is greater than 180 degrees.

The base 30 also includes a second upwardly projecting arcuate clasping surface 34 extending from a second end 48. The second arcuate surface 34 can be constructed to any desired radius but in the preferred embodiment of the present invention, the radius of curvature 50 of the second arcuate surface 34 is less than 180 degrees. The first arcuate surface 32 and the second arcuate surface 34 are oriented such that the concave inner surfaces thereof 52, 54 open inwardly towards an interior or middle section 56 of the base 30.

A post 58 extends upwardly from the middle section 56 of the base 30 to provide an anchor for the button 28 to be described in greater detail below. Preferably, the post 58 is generally cylindrical and extends vertically from a forward end 60 of the base 30. Even more preferably, the post 58 comprises a truncated cone 62 secured at a proximal end 64 to the base 30. The post 58 further comprises a truncated sphere 66 coaxially disposed above a distal end 68 of the truncated cone 62. In this way, the button 28 is removably secured to the base 30 through attachment of the clip 40 to the post 58 at the truncated vertex of the cone 62 immediately below the truncated bottom of the sphere 66.

Figure 4:
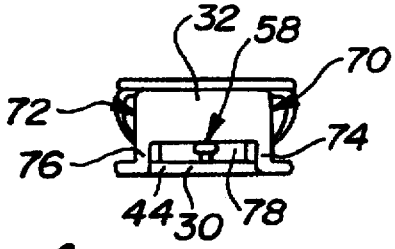
FIG. 4 is a schematic front view of a clasp portion of a clothing clasp in a closed position according to the present invention.

As best seen in FIG. 4, the first arcuate surface 32 includes a first outboard edge 70 laterally opposed from a second outboard edge 72. A first leg 74 downwardly projects from the first outboard edge 70 to the first end 44 of the base 30. Similarly, a second leg 76 downwardly projects from the second outboard edge 72 to the first end 44. Thus, the first arcuate surface 32 is suspended above the base 30 and the first and second legs 74, 76 define an opening 78 between the first arcuate surface 30 and the base 28. As will be described in greater detail below, the opening 78 provides access to the post 58 for adjoining the clip 40 thereto. Also, the legs 74, 76 on either side of the opening 78 interact with the sides of the clip 40 to prevent non-desired rotating of the button 28 relative to the fastener 26.

Figure 5:
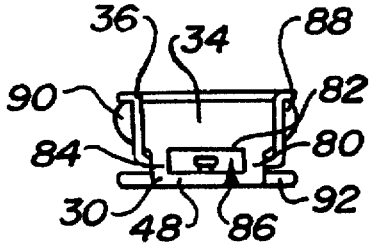
FIG. 5 is a schematic rear view of a clasp portion of a clothing clasp in a closed position according to the present invention.

As shown in FIG. 5, a first leg 80 downwardly projects from a bottom surface 82 of the second arcuate surface 34 to the second end 48 of the base 30. Similarly, a second leg 84 downwardly projects from the bottom surface 82 of the second arcuate surface 34 and the second end 48. Accordingly, the second arcuate surface 34 is suspended above the base 30 and the first and second legs 80, 84 define an opening 86 between the second arcuate surface 34 and the base 30.

The second arcuate surface 34 includes a first laterally extending flange 88 which overhangs a side of the base 30. The second arcuate surface also includes a second laterally extending flange 90 overhanging an opposite side of the base 30. The first and second laterally extending flanges 88, 90 bias the clamp 36 in a second position to effectuate a closed mode. As best seen in FIG. 2, it should be noted that the base 30 narrows at the shoulders 92 to the second end 48. In this way, the width of the base 30 plus the clamp 36 at the second end 48, is approximately equal to the width of the base 30 at the first end 44.

Figure 6:
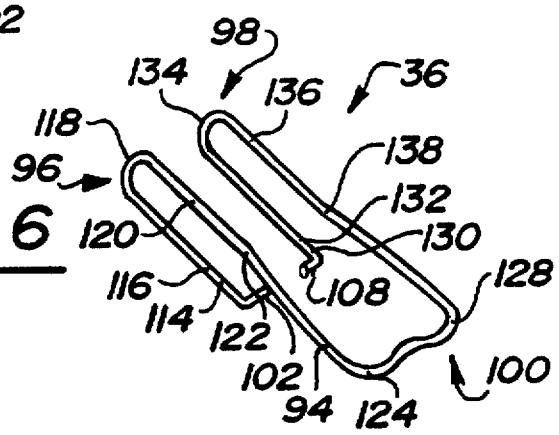
FIG. 6 is a perspective view of a spring clamp of a clothing clasp according to the present invention.

Referring now to FIGS. 2–5 and also FIG. 6, the generally U-shaped clamp 36 is journally secured to the base 30. The clamp 36 comprises a generally rectangular shaped body 94 having a first section 96 displaced from and generally opposite a second section 98. The first section 96 is connected to the second section 98 by an integrally formed V-shaped cross-member 100 extending therebetween.

The first section 96 includes an inwardly turned proximal end 102 adapted to engage an aperture 104 in a support 106 of the base 30. The support 106 is disposed at the union of the base 30 and the first leg 74. Preferably, the support 106 extends in a plane normal to both the base 30 and the first leg 74.

Similarly, the second section 98 includes an inwardly turned proximal end 108 adapted to engage an aperture 110 in a support 112 of the base 30. The support 112 is disposed at the union of the base 30 and the second leg 76. Preferably, the support 112 extends in a plane normal to both the base 30 and the second leg 76.

The first section 96 of the clamp 36 includes a rectangular rail 114 integral with and extending from the end 102. The rail 114 projects longitudinally away from the second end 48 of the base 30 and angles slightly inboard between the end 102 and a point 116. At the point 116, the rail 114 turns slightly outboard and longitudinally extends perpendicular to the second end 48.

The rail 114 joins an integrally formed U-shaped portion 118 which turns the first section 96 back toward the second end 48 of the base 30. From the U-shaped portion 118, an integrally formed second rail 120 extends above the rail 114 perpendicularly toward the second end 48 of the base 30 to a point 122. The second rail 120 angles slightly outboard from the point 122 to a corner 124.

At the corner 124, the first section 96 of the clamp 36 joins the integrally formed V-shaped cross-member 100. The V-shaped cross-member 100 extends to a corner 128 which initiates the second section 98. The second section 98 generally mirrors and is preferably symmetric with the first section 96.

The second section 98 includes a rail 130 integral with and extending from the end 108. The rail 130 projects longitudinally away from the second end 48 of the base 30 and angles slightly inboard between the end 108 and a point 132. At the point 132, the rail 130 turns slightly outboard and longitudinally extends perpendicular to the second end 48.

The rail 130 joins an integrally formed U-shaped portion 134 which turns the second section 98 back towards the second end 48 of the base 30. From the U-shaped portion 134, an integrally formed second rail 136 extends above the rail 130 perpendicularly toward the second end 48 of the base 30 to a point 138. The second rail 136 angles slightly outboard between the point 138 and the corner 128. At the corner 128, the second section 98 of the clamp 36 joins the integrally formed V-shaped cross-member 100.

Thus, the configuration of the clamp 36 is such that it tapers inboard slightly beyond the second end 48 of the base 30 and then extends longitudinally therefrom. The first and second laterally extending flanges 80, 90 are interposed between the first and second sections 96, 98 of the clamp 36. Also, the clamp 36 diverges to the V-shaped cross-member 100 to enhance its material holding capability. The V-shape of the cross-member 100 increases the contact surface area of the clamp 36.

Figure 7:
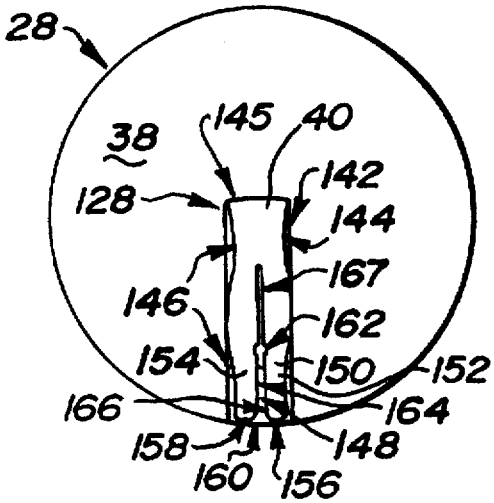
FIG. 7 is a schematic bottom view of a button portion of a clothing clasp including a clip secured thereto according to the present invention.

Turning now to FIG. 7, a more detailed view of the button 28 is shown. The button 28 includes a plastic wafer 38 adapted to be secured to the back of an ornamental piece such as that shown in FIG. 1. It should be noted that although a wafer is shown, any suitable brace, whether elliptical, square, octagonal, or otherwise, could be utilized for this purpose. The clip 40 is fixed to the wafer 38 such that the button 28 is removably mountable to the fastener 26.

Figure 8:
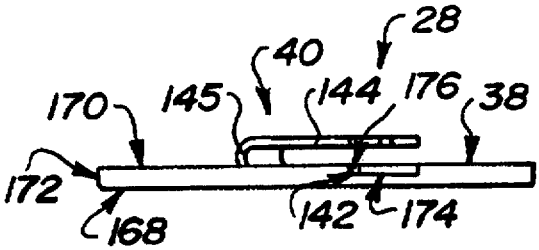
FIG. 8 is a schematic side view of a button portion of a clothing clasp including a clip secured thereto according to the present invention.

Referring also now to FIG. 8, the clip 40 is generally U-shaped and includes a first arm 142 and a bifurcated second arm 144 projecting from a U-shaped portion 145. The first arm 142 is preferably rectangularly shaped and is slightly shorter than the second arm 144. The second arm 144 is also generally rectangularly shaped although it is preferably concavely curved along its side walls 146 and includes a bifurcating slot 148 therein.

The slot 148 is formed in an end 150 of the second arm 144 to define a first axially extending finger 152 and a second axially extending finger 154. The first and second fingers 152, 154 include distal ends 156, 158 which are rounded to facilitate acceptance of the post 58 within the slot 148. The slot 148 includes an open end 160 between the distal ends 156, 158 which is flared slightly outward due to the rounded distal ends 156, 158. The slot 148 also includes an essentially circular closed end 162 adapted to accommodate the post 58.

The interior side walls 164, 166 of the slot 58 are essentially parallel and extend between the closed end 162 and the open end 160. It is preferable that the slot width between the interior walls 164, 166 be equal to or slightly less than the diameter of the post 58 at the truncated vertex of the cone 62 below the truncated bottom of the sphere 66. In this way, the first and second fingers 152, 154 spread slightly laterally as the post 52 is moved from the open end 160 to the closed end 162 of the slot 58. When the post 58 is seated within the closed end 162, the fingers 152, 154 return to an unspread or normal position to prevent the post 58 from backing out of the closed end 162. To facilitate this spreading, a slot extension 167 can be turned rearward at the closed end 162.

The wafer 38 includes a top surface 168, a bottom surface 170 and a side surface 172 extending therebetween. A groove 174 is formed in the bottom surface 170 of the wafer 38 to provide a receptacle for the first arm 142 of the clip 40. Preferably, the groove 174 is constructed to a predetermined depth approximately equal to the thickness of the first arm 142. Thus, when the clip 40 is fixed to the wafer 38 within the groove 174, an interior surface 176 of the first arm 142 is essentially co-planer with the bottom surface 170. In this way, the first arm 142 of the clip 40 does not interfere with the first end 44 of the base 30 upon mounting the button 28 to the fastener 26.

The width and length of the groove 174 are preferably slightly greater than the width and length of the first arm 142 for accommodating the same therein. Also, the groove 174 preferably extends from slightly beyond the midpoint 178 of the wafer 38 to the side surface 172. In this way, U-shaped portion 145 of the clip 40 is approximately concentrically disposed at the mid-point 178 of the wafer 38.

In operation, the bifurcated second arm 144 of the clip 40 is inserted through the opening 78 in the first arcuate surface 32 of the base 30. The post 58 enters the open end 160 of the slot 148 and is moved toward the closed end 162 spreading the first and second fingers 152, 154 laterally along the way. When the post 58 is seated in the closed end 162, the first and second fingers 152, 154 return substantially to a normal position to hold the post 58 within the closed end 162. The clip 40, and therefore the button 28, is prevented from rotating about the post 58 due to the location of the first leg 74 and second leg 76 adjacent either side of the second arm 144.

Figure 9:
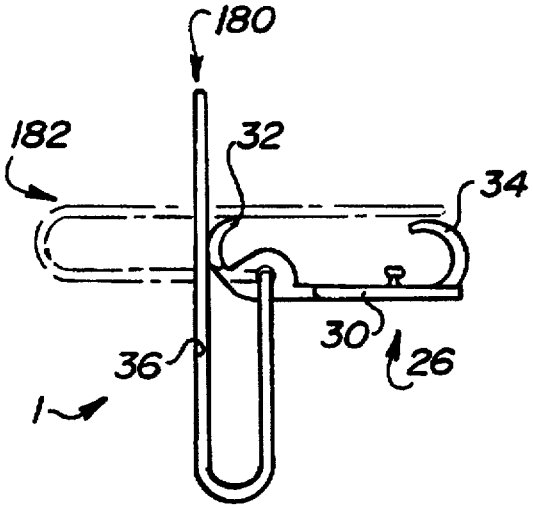
FIG. 9 is a schematic side view of a clasp portion of a clothing clasp in an open position according to the present invention.

Turning to FIG. 9, the fastener 26 is secured to the bodice intersection by initially rotating the clamp 36 to a first position 180 to orient the clasp 1 in an open mode. In the open mode, the clamp 36 is essentially perpendicular to the base 30. Rotating the clamp 36 separates the clamp 36 from the first and second arcuate clasping surfaces 32, 34 to provide access thereto.

The material of the garment is then aligned between the clamp 36 and the first and second clasping surfaces 32, 34. The clamp 36 is rotated to a second position 182 to configure the clasp 1 in a closed mode. In the closed mode, the damp 36 is essentially parallel with the base 30.

In the closed mode, the damp 36 is positioned adjacent the first and second rasping surfaces 32, 34 and securely holds the garment material therebetween. It should be noted that the radius of curvature of the first arcuate surface 32 and its position along the interior edge of the clamp 36 provides the biasing force to keep the clasp 1 in the closed mode. Also, the second arcuate surface 34 prevents the clamp 36 from rotating beyond a desired amount.

Thus, it can be appreciated that the present invention provides a closure device for securing one or more pieces of garment material together. The device is particularly well suited for securing a first side and a second side of a V-neck blouse, dress, or blazer bodice together. Accordingly, gaping or opening and exposure thereunder is prevented. Furthermore, the garment wearer may decoratively accent the outfit and conceal the clasp.

Those skilled in the art can now appreciate from the foregoing description that the broad teachings of the present invention can be implemented in a variety of forms.

Therefore, while this invention has been described in connection with particular examples thereof, the true scope of the invention should not be so limited since other modifications will become apparent to the skilled practitioner upon a study of the drawings, specification, and following claims.

What is claimed is:

1. A garment closing apparatus comprising:

a base;

a clasping member upwardly extending from said base, said clasping member including an outer radial caming surface;

a clamp rotatably secured to said base so as to be moveable to engage said clasping member along said outer radial taming surface such that said clamp is frictionally held in a closed position and an open position by said outer radial earning surface;

a post extending from said base;

a clip including a slot therein adapted to receive said post; and a decorative covering secured to said clip.

2. The apparatus of claim 1 wherein said clasping member is generally arcuately shaped and opens inwardly towards an interior of said base.

3. The apparatus of claim 1 wherein said post comprises a conical projection having a spherical end.

4. The apparatus of claim 3 wherein said post further comprises:

a truncated cone vertically secured at a proximal end to a forward portion of said base; and a truncated sphere coaxially disposed above a distal end of said truncated cone.

5. The apparatus of claim 1 wherein said clamp further comprises:

a generally U-shaped bar having longitudinally extending opposed first and second sections;

an integrally formed cross member connecting said first and second sections;

a first end of said first section rotatably secured to a first outboard edge of said base; and a first end of said second section rotatably secured to a second outboard edge of said base.

6. The apparatus of claim 1 wherein said clip further comprises:

a generally U-shaped body portion;

a first arm of said U-shaped body portion including said slot formed therein;

a first longitudinally projecting finger extending along a first side of said slot;

a second longitudinally projecting finger extending along a second side of said slot; and said slot including a circularly shaped closed end and an open end and being adapted to laterally spread as said post is moved from said open end to said closed end and to return to a substantially normal position upon said post being positioned in said closed end.

7. The apparatus of claim 1 wherein said decorative covering further comprises:

a bottom surface including a groove formed therein; and said groove being adapted to receive said clip such that an inwardly facing surface of an arm of said clip is essentially co-planer with said bottom surface.

8. The apparatus of claim 1 wherein said clasping member further comprises:

a first arcuate surface;

a first leg downwardly extending from a outboard edge of said first arcuate surface to a first end of said base;

a second leg downwardly extending from a second outboard edge of said first arcuate surface to said first end of said base;

said first leg and said second leg defining an opening between said first arcuate surface and said base; and said opening being adapted to receive an arm of said clip therethrough and to prevent substantial rotation thereof.

9. An apparatus for securing together a right side and a left side of a bodice comprising:

a base including a first end and a second end;

a conical projection including a spherical head vertically extending from a forward end of said base;

a first arcuate clasping surface upwardly extending from said first end and defining an opening therebetween;

a second arcuate clasping surface upwardly extending from said second end;

a first support extending in a plane normal to said base and said first arcuate surface;

a second support extending in a plane normal to said base and said first arcuate surface;

a spring clamp including a first end rotatably engaging said first support;

a second end of said spring clamp rotatably engaging said second support;

a U-shaped clip including a first axially extending arm and a second axially extending arm;

said first axially extending arm including a slot formed therein;

said U-shaped clip adapted to be removably coupled to said base by interconnecting said slot with said conical projection;

a wafer including a bottom surface;

said bottom surface including a groove formed therein; and said clip being secured to said groove such that an inwardly facing surface of said second axially extending arm is essentially co-planer with said bottom surface.

10. The apparatus of claim 9 wherein said spring clamp further comprises a first U-shaped member extending from said first end and a second U-shaped member extending from said second end, said first and second U-shaped members being interconnected by a V-shaped cross member extending therebetween.

11. The apparatus of claim 10 wherein said first U-shaped member and said second U-shaped member diverge from said first and second ends to said V-shaped cross member.

12. The apparatus of claim 9 wherein said conical projection further comprises:

a truncated cone secured at a proximal end to a forward end of said base; and a truncated sphere concentrically disposed above a distal end of said truncated cone.

13. The apparatus of claim 9 wherein said slot further comprises:

a circularly shaped closed end having a diameter substantially equal to a diameter of said conical projection;

generally parallel side walls having a width less than or equal to said diameter of said conical projection;

said parallel side walls defining a first axially projecting finger including a rounded distal end and a second axially projecting finger including a rounded distal end; and said rounded distal ends defining an open end of said slot having a width greater than said diameter of said conical projection;

whereby said slot laterally spreads as said conical projection moves from said open end to said closed end and substantially returns to a normal position upon said conical projection entering said closed end.

14. The apparatus of claim 9 wherein said opening between said first arcuate clasping surface and said first end of said base is adapted to pass said first axially extending arm therethrough to engage said conical projection in said slot and to substantially prevent said clip from rotating.

15. A method of securing together two or more pieces of garment material comprising:

rotating a generally U-shaped clamp pivotally secured to a base to an open position;

aligning said pieces of said material along a first arcuate clasping surface upwardly extending from said base and a second arcuate clasping surface upwardly extending from said base;

rotating said clamp to a closed position to secure said material between said clamp and said first and second clasping surfaces; and coupling a wafer to said base to conceal said clamp.

16. The method of claim 15 wherein said open position provides access between said U-shaped clamp and said first and second arcuate clasping surfaces.

17. The method of claim 16 wherein said closed position aligns said U-shaped damp adjacent said first and second arcuate clasping surfaces.

18. The method of claim 16 wherein said coupling of said base includes passing a first arm of a U-shaped clip fixed to said wafer through an opening of said first arcuate surface and engaging a conical projection of said base in a slot at said first arm.

19. The method of claim 18 wherein said conical projection comprises:

a truncated sphere secured at a proximal end to a forward end of said base; and a truncated sphere coaxially disposed above a distal end of said truncated cone.

20. The method of claim 18 wherein said slot comprises:

a circularly shaped closed end having a diameter substantially equal to a diameter of said conical projection;

generally parallel side walls having a width less than or equal to said diameter of said conical projection;

said parallel side walls defining a first axially projecting finger including a rounded distal end and a second axially projecting finger including a rounded distal end; and said rounded distal ends defining an open end of said slot having a width greater than said diameter of said conical projection;

whereby said slot laterally spreads as said conical projection moves from said open end to said closed end and returns to a normal position upon said conical projection entering said closed end.

21. A garment closing apparatus comprising:

a base;

a clasping member upwardly extending from said base, said clasping member including a pair of downwardly extending legs coupled to said base and defining an opening between an upper surface of said clasping member and said base;

a clamp rotatably secured to said base so as to be movable to engage said clasping member;

a post extending from said base;

a clip including a slot therein adapted to receive said post, said clip including an arm insertable through said opening and coacting with said pair of legs to prevent substantial rotation of said clip relative to said base; and a decorative covering secured to said clip.

22. The apparatus of claim 21 wherein said post comprises a conical projection.

23. The apparatus of claim 22 wherein said post further comprises:

a truncated cone vertically secured at a proximal end to a forward portion of said base; and a truncated sphere coaxially disposed above a distal end of said truncated cone.

24. The apparatus of claim 21 wherein said clamp further comprises:

a generally U-shaped bar having longitudinally extending opposed first and second sections;

a cross-member connecting said first and second sections;

a first end of said first section rotatably secured to a first outboard edge of said base; and a first end of said second section rotatably secured to a second outboard edge of said base.

25. The apparatus of claim 21 wherein said clip further comprises:

a generally U-shaped body portion;

a first arm of said U-shaped body portion including said slot formed therein;

a first longitudinally projecting finger extending along a first side of said slot;

a second longitudinally projecting finger extending along a second side of said slot; and said slot including a circular closed end and an open end and being adapted to laterally spread as said post is moved from said open end to said closed end and to return to a substantially normal position upon said post being positioned in said closed end.

26. The apparatus of claim 21 wherein said decorative covering further comprises:

a bottom surface including a groove formed therein, said groove being adapted to receive said clip such that an inwardly facing surface of a second arm of said clip is essentially co-planar with said bottom surface.

* * * * *

UNITED STATES PATENT AND TRADEMARK OFFICE

CERTIFICATE OF CORRECTION

PATENT NO. : 5,729,875

DATED : March 24, 1998

INVENTOR(S) : Ann M. Margulis, et al.

It is certified that error appears in the above-indentified patent and that said Letters Patent is hereby corrected as shown below:

Title page, item [57],
Abstract line 6; Application, Abstract line 6;
"dosing" should be -- closing --;

Column 1, line 19, (application page 1, line 11)
"Bodice" should be -- bodice --.

Column 1, line 45, (application page 2, line 10);
"dosing" should be -- closing --.

Column 1, line 50, (application page 2, line 16)
"dip" should be -- clip --.

Column 6, line 47, (application page 13, line 2)
"damp" should be -- clamp --.

Column 6, line 49, (application page 13, line 3)
"damp" should be -- clamp --.

UNITED STATES PATENT AND TRADEMARK OFFICE

CERTIFICATE OF CORRECTION

PATENT NO. : 5,729,875

DATED : March 24, 1998

INVENTOR(S) : Ann M. Margulis, et al.

It is certified that error appears in the above-indentified patent and that said Letters Patent is hereby corrected as shown below:

Column 6, line 50, (application page 13, line 4)
"rasping" should be -- clasping --.

Column 7, line 14, claim 1, (application page 2, line 6, claim 1)
Amendment dated 8/27/97;
"taming" should be --caming --.

Column 9, line 30, claim 17, (application page 20, line 2, claim 17,
"damp" should be -- clamp --.

Signed and Sealed this

Thirtieth Day of June, 1998

*Attest:*

*Attesting Officer*

Bruce Lehman

BRUCE LEHMAN

*Commissioner of Patents and Trademarks*